United States Patent [19]

Potts

[11] Patent Number: 4,733,828

[45] Date of Patent: Mar. 29, 1988

[54] MINERAL BREAKER

[75] Inventor: Alan Potts, Nottingham, United Kingdom

[73] Assignee: MMD Design & Consultancy Limited, England

[21] Appl. No.: 14,135

[22] Filed: Jan. 30, 1987

Related U.S. Application Data

[63] Continuation of Ser. No. 814,015, Dec. 20, 1985, abandoned, which is a continuation of Ser. No. 570,633, Jan. 13, 1984, abandoned.

[30] Foreign Application Priority Data

Jan. 20, 1983 [GB] United Kingdom ..... 8301549
Jul. 6, 1983 [GB] United Kingdom ..... 8318297

[51] Int. Cl.[4] ..... B02C 18/18

[52] U.S. Cl. ..... 241/236; 241/294; 241/295; 299/91

[58] Field of Search ..... 241/293, 294, 295, 236, 241/191, 197, 300, 195; 299/91, 92, 93

[56] References Cited

U.S. PATENT DOCUMENTS

| | | | |
|---|---|---|---|
| 1,187,163 | 6/1916 | McKee et al. | 241/300 |
| 1,351,892 | 9/1920 | Corrigan | 299/91 X |
| 2,802,650 | 8/1957 | Straight | 241/197 X |
| 3,642,214 | 2/1972 | Blackwell, Jr. | 241/197 X |
| 4,202,504 | 5/1980 | Cameron | 241/197 X |
| 4,311,284 | 1/1982 | Ratcliff, Jr. | 241/191 |
| 4,344,581 | 8/1982 | Redemann | 241/191 X |
| 4,374,573 | 2/1983 | Rouse et al. | 241/197 X |

FOREIGN PATENT DOCUMENTS

| | | | |
|---|---|---|---|
| 515085 | 12/1930 | Fed. Rep. of Germany | 241/300 |
| 711446 | 6/1954 | United Kingdom | 241/300 |

*Primary Examiner*—P. W. Echols
*Assistant Examiner*—Joseph M. Gorski
*Attorney, Agent, or Firm*—Ratner & Prestia

[57] ABSTRACT

A mineral breaker having at least one breaker drum, the drum including a generally cylindrical support body from which a plurality of radially extending projections project by a distance equal to at least half the radius of the body, each projection being covered by a tooth sheath to define a breaker tooth having a maximum radial dimension projecting beyond the circumference of the support body which is greater than a major portion of the radius of the support body.

8 Claims, 15 Drawing Figures

MINERAL BREAKER

This application is a continuation of application Ser. No. 814,015, now abandoned, filed 12/20/85, which is a continuation of application Ser. No. 570,633, filed 1/13/84 and now abandoned.

This invention relates to a mineral breaker.

The invention is particularly concerned with a mineral breaker of the type having replaceable tooth sheaths mounted on a support body as illustrated in our PCT publication No. WO 83/02071.

According to one aspect of the present invention there is provided a mineral breaker having at least one breaker drum, the drum including a generally cylindrical support body from which a plurality of radially extending projections project, at least some of the projections being arranged in circumferentially extending group and being covered by a tooth sheath to define a breaker tooth, each projection having a forwardly facing formation for co-operation with the trailing end of the preceding tooth sheath for restraining radial outward movement of said trailing end.

According to another aspect of the invention there is provided a mineral breaker having at least one breaker drum, the drum including a generally cylindrical support body from which a plurality of radially extending projections project, at least some of the projections being covered by a tooth sheath to define a breaker tooth, each tooth including a replaceable tip.

According to a further aspect of the present invention there is provided a mineral breaker having at least one breaker drum, the drum including a generally cylindrical support body from which a plurality of radially extending projections project, at least some of the projections being covered by a tooth sheath to define a breaker tooth, the leading face of each tooth sheath being shaped so as to maintain a sharp profile as it is worn away.

Reference is now made to the accompanying drawings, in which.

Figure 1:
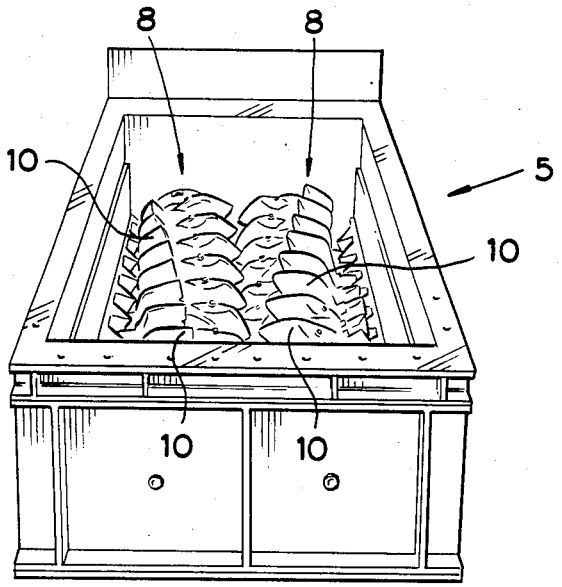
FIG. 1 is a schematic perspective view of a mineral breaker.

A mineral breaker 5 is schematically illustrated in FIG. 1 and includes a pair of breaker drums 8 rotatably mounted in a housing 9. The drums 8, in use, rotate in opposite directions to direct mineral to be broken between themselves, the breaker teeth 10 on respective drums co-operating with one another to break down oversized mineral.

Figure 2:
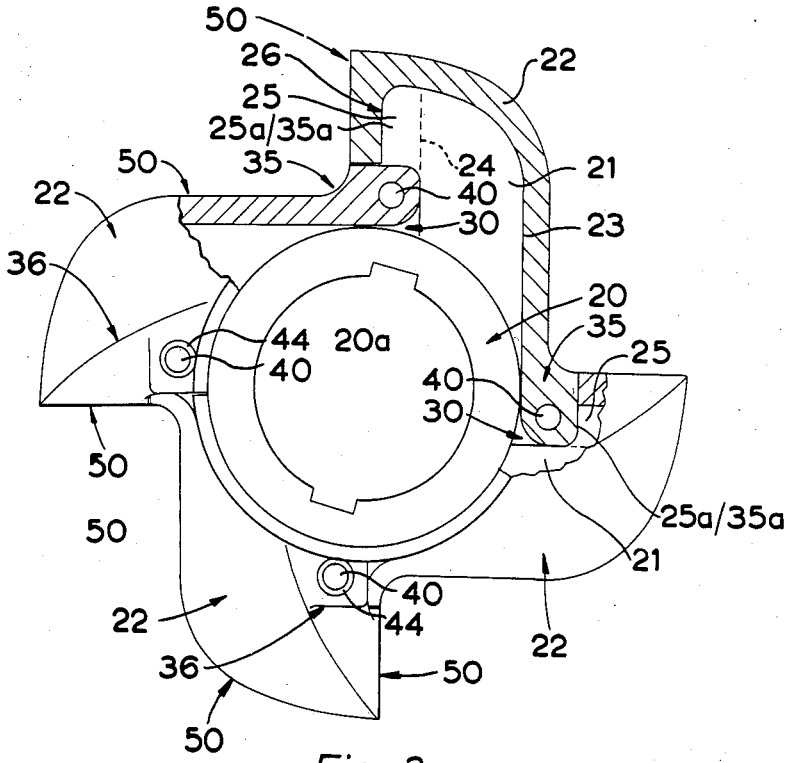
FIG. 2 is an end view, partly in section, of a first embodiment according to the present invention.
Figure 3:
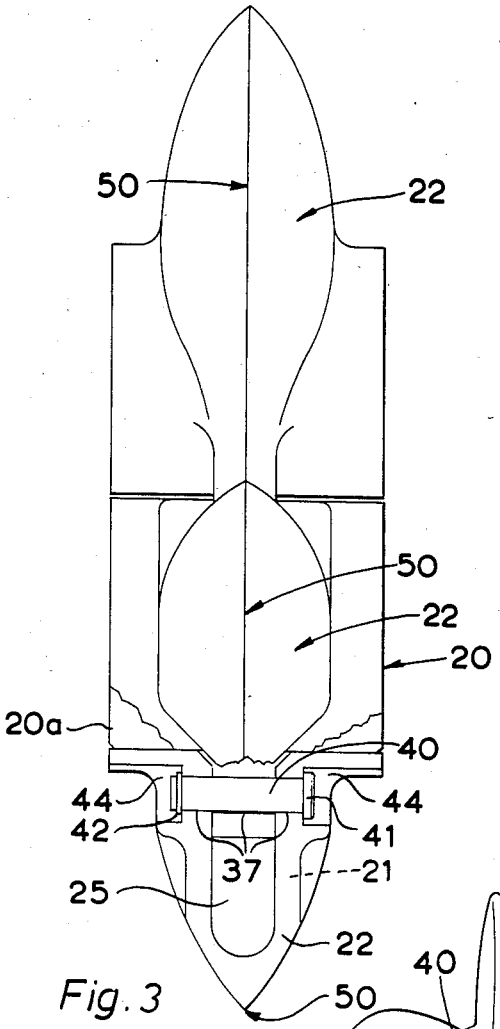
FIG. 3 is a front view, partly in section, of the first embodiment shown in FIG. 2.

Each breaker drum 8 includes a shaft (not shown) on which is received a series of annular support rings 20 as shown in FIGS. 2 and 3, the series of support rings forming a support body of cylindrical form.

It is envisaged that each support body need not be of circular cross-section but may be polygonal. Each ring 20 has a series of integral projections 21 which in use support and are covered by tooth sheaths or caps 22 to define breaker teeth 10. In the illustrated embodiment, four projections 21 are illustrated but it will be appreciated that more or less than four projections may be provided as desired, for example rings having 3, 4, 5 or 6 projections are possible.

In FIGS. 2 and 3 each projection 21 is generally circular in cross-section and defines a rearward face 23 which is substantially linear and which extends substantially tangentially to the annulus body portion 20*a* of the support ring.

In the embodiment shown in FIGS. 2 and 3 the forward face 24 of each projection 21 carries a protrusion 25 which serves as a key for locating the tooth cap 22 and also provides a support surface 26 which is spaced from the face 24 and against which the inner face of the cap 22 abuts.

Figure 4:
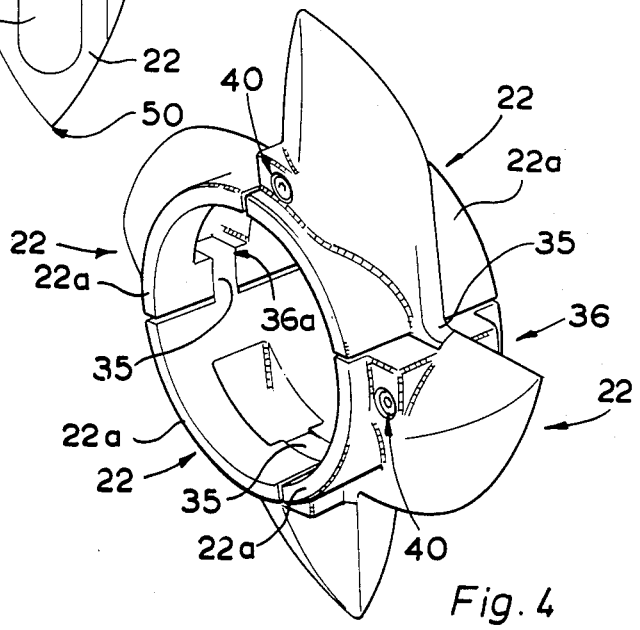
FIG. 4 is a perspective view of the embodiment shown in FIG. 2 with the support body removed.

As more clearly seen in FIG. 4, each tooth cap 22 has a cover portion 22*a* which in use serves to cover and protect the peripheral surface of the associated ring. Projecting from the trailing end of each cover portion is a lug 35. The protrusion 25 is spaced from the body portion 20*a* to define a forwardly facing formation in the form of a recess or gap 30 into which the lug 35 of the preceding tooth cap projects. The front portion 36 of each tooth cap 22 has an aperture 36*a* (FIG. 4) through which the lug 35 projects to be received in said recess and each front portion 36 and lug portion 35 is provided with laterally extending bores 37 which align with one another to receive a spigot 40. Each spigot 40 has an enlarged head 41 at one end and a removable circlip 42 at the other end for permitting insertion and removal of the spigot 40. The head 41 and circlip 42 are housed within enlarged bores 44 formed in the front portion 36.

The connection between adjacent tooth caps is therefore located behind the leading face of each tooth cap and thereby enables a smooth, unhindered, transition in profile between succeeding tooth caps to be achieved.

The lug 35 of each tooth cap has an upper bearing face 35*a* which abuts against the radially innermost face 25*a* of the protrusion. Accordingly the lug 35 is restrained from moving radially outwardly by the protrusion. The front portion of each tooth cap when connected to the lug 35 of the preceding tooth is thereby also restrained from moving radially outwardly.

This co-operation between projections 21 and tooth caps 22 is such as to provide stability of the tooth caps 22 in use and substantially reduces chatter. Additionally, it is possible with the present construction to provide a large bearing face between the spigot and the front portion of each tooth cap which is advantageous in reducing wear. Accordingly during use, each projection and associated cap function together as a composite tooth, the cap providing resistance to wear whilst the projection provides support for absorbing the working loadings.

In the embodiment illustrated in FIGS. 2 to 4 each tooth cap is shown as preferably including a ridge 50 which extends along its entire length and which serves to define a chisel-like edge which facilitates breakage of mineral.

The above construction is suitable for incorporation in a single or twin drum mineral sizer of the type described in our United Kingdom Patent Application Nos: 8136347 and 8225977 (PCT publication No. WO 83/02071).

It is envisaged that the co-operation between the trailing end of each tooth cap and the succeeding projection for restraining radial outward movement of the trailing end may be achieved in other ways, for instance the forward face of each projection may be inclined to define an acute angle with the periphery of the ring in order to provide a surface against which the lug 35 may abut.

It has been found that the above construction enables adjacent tooth caps to be reliably and easily connected to one another by fixing means such as bolts which are totally external of the projections 21. Accordingly the projections 21 are not weakened by through bores necessary for fixing means. Additionallyminimum size of each projection 21 is not determined by the fixing means.

It has also been found that the above construction enables large teeth 10 to be created, for example teeth having a radial height dimension in excess of the radius of the support ring are possible.

Embodiments illustrating modifications in the shape of the tooth sheath are hereinafter described with reference to FIGS. 5 to 14.

In the embodiment 110 in FIGS. 5 to 8, the tooth sheath or cap 12 is provided with a replaceable tip 14 which is made from a very hard material such as tungsten carbide. The tip 14 has a generally conically shaped head 16 terminating in a point 17 and a stem 18 which projects into a bore 19 formed in the cap 12. The stem 18 and bore 19 co-operate to restrain lateral displacement of the tip 14 and are of a length sufficient to cope with laterally directed loadings applied to the tip head 16. The tip 14 is retained in position by means of a removable pin (not shown) which extends through bore 124 formed in the cap 12. It is envisaged that the bore 19 may be defined by a sleeve of for example a suitable steel inserted into the cap 12 in order to resist loosening of the tip within the bore 19 which may occur if the bore is unsleeved.

The orientation of the tip relative to the tooth cap's arcuate surface 130 (not shown in FIG. 7) which normally seats upon the drum is chosen bearing in mind the type of mineral to be broken.

Figure 5:
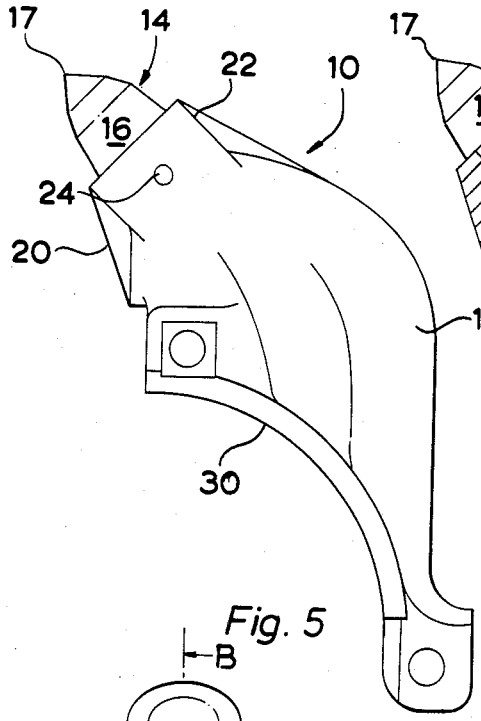
FIG. 5 is a side view of a second embodiment of a tooth sheath according to the present invention.
Figure 8:
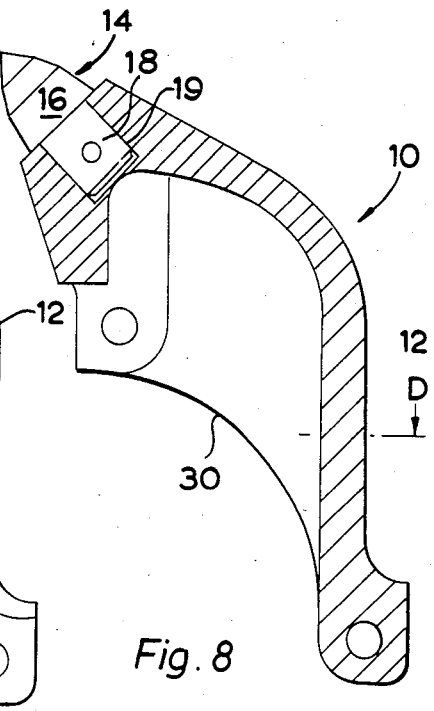
FIG. 8 is a section view taken along line B—B in FIG. 6 and showing the removable tip in position.
Figure 6:
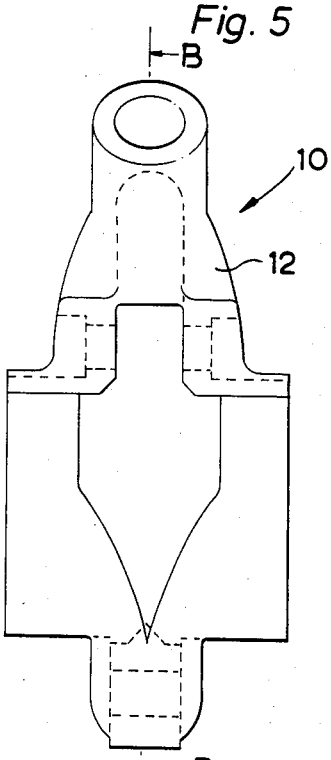
FIG. 6 is a front view of the tooth sheath shown in FIG. 5 without the removable tip as seen in the direction of arrow A.
Figure 7:
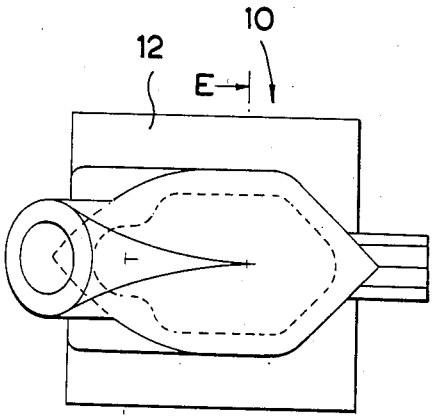
FIG. 7 is a plan view of the tooth construction shown in FIG. 6.

In FIGS. 5 and 8 the tip 14 is arranged so that its point 17 projects forwardly of the leading edge 120 of the tooth cap 12 and also projects above the uppermost edge 122 of the tooth cap.

Figure 9:
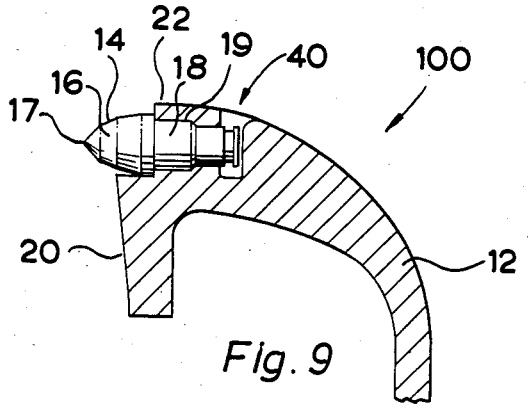
FIG. 9 is a partial sectional view similar to FIG. 8 of a third embodiment according to the present invention.
Figure 10:
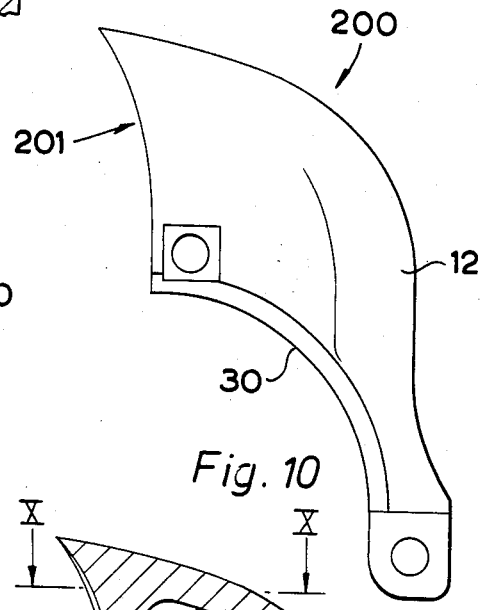
FIG. 10 is a side view of a fourth embodiment according to the present invention.
Figure 11:
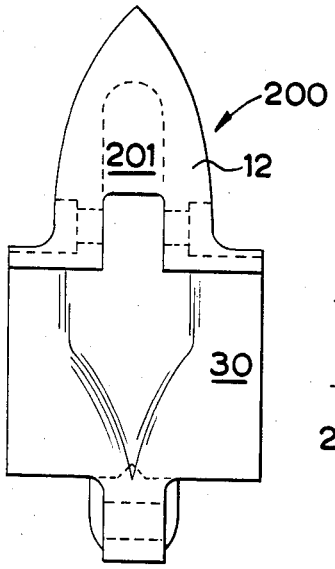
FIG. 11 is a front view of the fourth embodiment.
Figure 12:
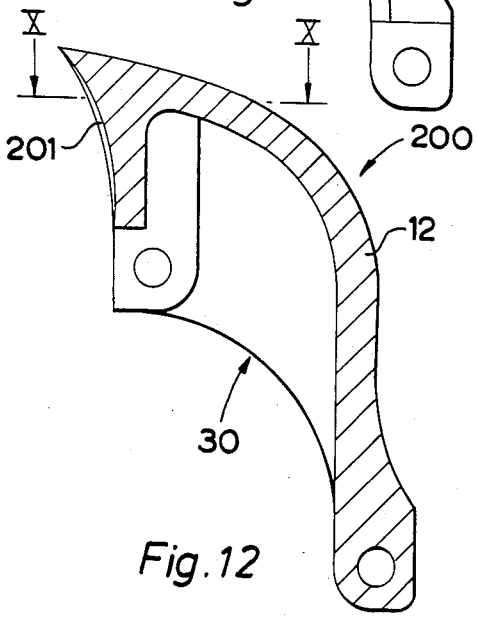
FIG. 12 is a sectional view taken along line BB—BB in FIG. 11.
Figure 13:
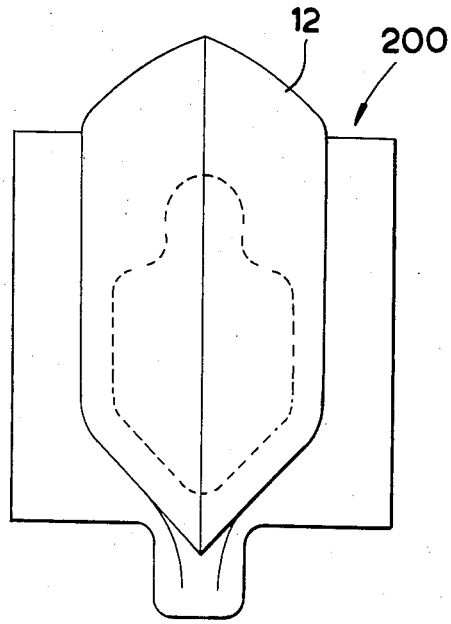
FIG. 13 is a plan view of the fourth embodiment.
Figure 14:
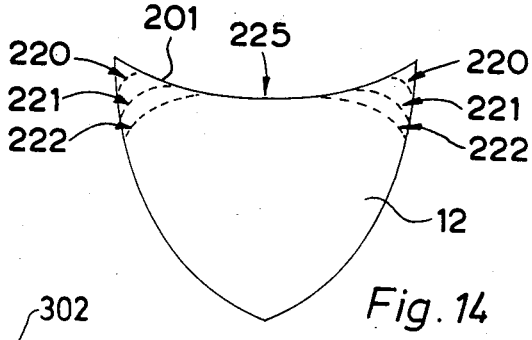
FIG. 14 is a schematic cross-sectional view along lines X—X in FIG. 12.

In the embodiment 100 of FIG. 9 the tip is arranged so that its point 17 projects forwardly of the leading edge 120 only. In the embodiment 100 the cap 12 is provided with a recess 140 in order to give access to the rear portion of the tip stem 18 so that a removable circlip may be fitted to the stem 18 to prevent its removal.

The orientations of the tip 14 illustrated in embodiments 110 and 100 are to be regarded as an indication of possible extremes of orientation and that other orientations, particularly those residing between the two illustrated orientations, may be adopted in practice.

When deciding on the orientation of the tip 14 considerations such as hardness, abrasiveness and shatterability of the mineral to be handled are taken into account. In this respect the tip orientation illustrated in FIG. 5 has been found to be suitable for minerals which do not easily shatter and so tend to cause abrasion on the uppermost edge 122. Since the tip 14 in FIG. 5 projects above the uppermost edge 122 it has been found that this edge is afforded some protection against abrasive wear.

Where minerals exhibit higher tensile strengths it has been found desirable to orientate the tip 14 in the manner illustrated in FIG. 9 so that loadings applied to the tip 114 during breaking are directed axially of the tip thereby enabling it and the cap to withstand higher impact loadings.

The provision of a removable tip 14 has the advantage of providing a relatively small component which can be made of a very hard material so that the tip can cope with the working environment. Additionally it enables the tip 14 to have a head which has a sharp profile which particularly facilitates shattering of the larger lumps of mineral which undergo a primary breaking action. This has the advantage of enabling large lumps of mineral to be quickly broken down thereby enabling the mineral breaker to handle and maintain large throughputs of mineral. In the event of the tip wearing down, it is a simple matter to replace the worn tip for a new one. Accordingly time period for replacement of the tooth cap 12 are extended since the upper part of the tooth cap is to some extent protected from abrasive wear by the tip 14.

It has been found that certain minerals are highly resistant to fracture on impact and that these minerals can cause the tips 14 to shatter. For such minerals it has been found possible to design other shapes of the leading face of the tooth cap in such a way that it maintains an efficient breaking profile i.e. a sharp profile as it is worn away by the mineral. Accordingly, as shown in FIGS. 10 to 14 a tooth 200 is shown which is cast from a manganese steel. The leading face 201 is designed so that its peripheral edge is upstanding in relation to the remainder of the face. It is preferred to shape the face 201 so that it is concave across its width and height. Accordingly as shown in FIGS. 10 to 14, in side view the leading face 201 has a hook like appearance.

In use, when mineral is first fed through the breaker, the repeated impacts of the teeth on the mineral cause deformation and work hardening of the material from which the tooth caps are cast. The shape chosen for the face 201 is chosen bearing in mind this deformation and is such that when work hardening of the tooth cap has reached a predetermined hardness the tooth shape in cross-section assumes a cross-sectional profile as illustrated by the dotted line 220 in FIG. 14, the original shape being shown in solid lines. When this initial work hardened profile is attained, the tooth cap becomes stable against further deformation and wears away as schematically illustrated by successive broken lines 221, 222. During change of profile shape up to about line 221 the tooth face 201 as viewed in FIG. 12 maintains a central concave portion 225 which maintains the gripping efficiency of the tooth.

Accordingly, the material from which the cap is cast and the degree of curvature of the face 201 are chosen so that after initial deformation and work hardening a situation is aimed for where the rate of wear of the tooth profile is less than the rate of maintaining the work hardened surface.

Figure 15:
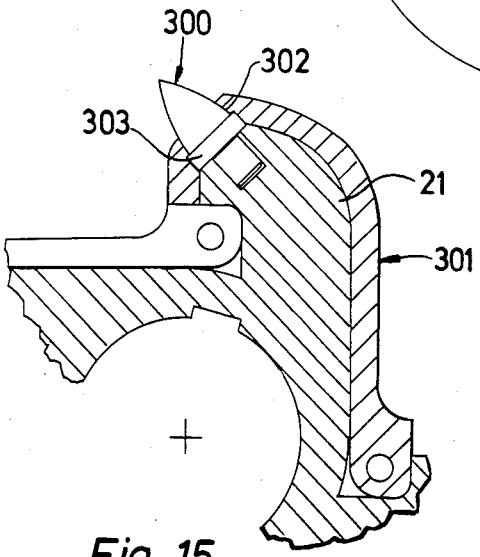
FIG. 15 is a partial sectional view similar to FIG. 8 of a fifth embodiment according to the present invention.

A fifth embodiment is illustrated in FIG. 15 which is similar to the second and third embodiments in that the breaker tooth is provided with a replaceble tip 300. In the fifth embodiment, the replaceable tip 300 is directly mounted in the projection 21 which the tooth sheath 301 covers; the tooth sheath being provided with an aperture 302 through which the tip projects. In this way the replaceable tip 300 transmits breaking forces directly onto the projection 21 so that the tooth sheath primarily acts to protect the projection 21 from abrasive wear. Preferably the replaceable tip 300 is provided with an annular flange 303 which forms a wide shoulder which abuts against a supporting face formed on the projection so as to spread the impact loadings. This form of construction is particularly advantageous for large breaker teeth which are intended to act upon hard rock such as tarra.

The annular flange 303 also co-operates with the cover to restrain removal of the tip 300. If the flange 303 is not provided then a retaining pin (not shown) passing through the projection to co-operate with the stem of the tip 300 would be used in order to restrain removal of the tip.

I claim:

1. In a mineral breaker including a breaker drum having an axis and a plurality of breaker teeth projecting radially from the drum and arranged in circumferentially extending groups of teeth spaced along the axis of the drum, each of said breaker teeth having a leading face, and further including a plurality of opposed breaker teeth positioned so that on rotation of the drum mineral lumps to be broken are gripped between the leading face of the teeth on the drum and a pair of said opposed teeth to thereby break the mineral lump gripped therebetween by a snapping action, the improvement of each of the breaker teeth in each circumferentially extending group comprising a radially extending projection enveloped by a tooth sheath, each projection having a forwardly facing recess into which a trailing end of its immediately preceding tooth sheath is received for restraining radial outward movement of said trailing end, each sheath having a leading wall provided with an opening through which said trailing end of its preceding tooth sheath passes to enter said recess.

2. A mineral breaker according to claim 1 wherein said trailing end of each sheath is defined by a lug.

3. A mineral breaker according to claim 2 wherein:

(a) each lug includes a laterally extending bore, (b) the leading wall of each sheath is provided with a laterally extending bore which is in alignment with the bore of the lug passing therethrough, and (c) a bolt extends through each set of said aligned bores for securing adjacent sheaths in a group to one another.

4. A mineral breaker according to claim 1, 2 or 3 wherein each projection is mounted on a support body and said recess is defined by a forwardly extending protrusion on the projection, the protrusion being spaced from the periphery of the support body to define said recess.

5. A mineral breaker according to claim 4 wherein the support body is defined by a series of adjacent support rings, each ring mounting a group of said breaker teeth.

6. A mineral breaker according to claim 4 wherein each breaker tooth on said drum has a radial height which is greater than the radius of the support body.

7. A mineral breaker according to claim 1 wherein there are between 2 to 6 breaker teeth in each of said groups of teeth.

8. A mineral breaker according to claim 1 wherein each tooth sheath is provided with a replaceable tip.

* * * * *